US005673974A

United States Patent [19]

Lammer et al.

[11] Patent Number: 5,673,974

[45] Date of Patent: Oct. 7, 1997

[54] DRY DUST REMOVAL DEVICE

[75] Inventors: Egmont Lammer, Knittelfeld; Alfred Zitz, Zeltweg, both of Austria

[73] Assignee: Voest-Alpine Bergtechnik Gesellschaft m.b.H., Zeltweg, Austria

[21] Appl. No.: 553,392

[22] PCT Filed: Mar. 15, 1995

[86] PCT No.: PCT/AT95/00047

§ 371 Date: Nov. 15, 1995

§ 102(e) Date: Nov. 15, 1995

[87] PCT Pub. No.: WO95/25218

PCT Pub. Date: Sep. 21, 1995

[30] Foreign Application Priority Data

Mar. 15, 1994 [AT] Austria ..... 556/94

[51] Int. Cl.[6] ..... E21C 35/22

[52] U.S. Cl. ..... 299/12; 55/304; 299/64

[58] Field of Search ..... 299/12, 64; 55/304, 55/467, 471, 218

[56] References Cited

U.S. PATENT DOCUMENTS

| | | | |
|---|---|---|---|
| 2,375,689 | 5/1945 | Reeder | 299/12 X |
| 3,041,808 | 7/1962 | Snyder | 55/304 |
| 3,700,284 | 10/1972 | Agnew | 299/46 |
| 3,712,678 | 1/1973 | Amoroso | 299/68 |
| 4,289,509 | 9/1981 | Hölter | 55/257.2 |
| 4,531,784 | 7/1985 | Karlovsky | 299/64 |
| 5,253,925 | 10/1993 | Modzik, Jr. | 299/12 |

FOREIGN PATENT DOCUMENTS

| | | |
|---|---|---|
| 0 079 260 | 5/1983 | European Pat. Off. . |
| 2 235 265 | 1/1975 | France . |
| 26 35 405 | 2/1978 | Germany . |
| 30 06 401 | 9/1981 | Germany . |
| 2 049 760 | 12/1980 | United Kingdom . |

*Primary Examiner*—David J. Bagnell
*Attorney, Agent, or Firm*—Cushman Darby & Cushman IP Group of Pillsbury Madison & Sutro

[57] ABSTRACT

The dry dust removal device for tunnelling or extraction machines includes a suction fan (15) and suction openings (14) close to the cutting rolls (23). There is a filter element (12) arranged above the conveyor device (2) of the tunnelling or extraction machine (1), wherein closeable openings (16) are connected in the housing of the dry dust removal device (7) above the conveyor device (2) and air outlet openings (19) are connected on the opposite side of the filter element (12).

10 Claims, 4 Drawing Sheets

DRY DUST REMOVAL DEVICE

This application claims benefit of international application PCT/AT95/00047, filed May 15, 1995.

BACKGROUND OF THE INVENTION

1. Field of the Invention

The invention relates to a dry dust removal device for tunnelling or extraction machines, comprising a suction fan and suction openings close to the work surface.

2. The Prior Art

Dust removal devices for tunnelling or extraction machines usually comprise an exhaust duct and a duct for feeding fresh air. The exhaust duct may be connected to suction channels provided on the tunnelling or extraction machine, intake openings or suction openings already having been provided near the facing. With such ventilation devices it was mostly common at the same time to precipitate part of the dust by water. However, dust precipitation by water spraying is not readily feasible, in particular, in potassium mines because this would make the air aggressive, thus creating inacceptable working conditions near the work surface.

The connection of an airduct to a tunnelling machine impedes the manoeuvrability of the same such that there are limitations. In particular, at high temperatures at place, amounting up to 50° C., it is, moreover, also necessary to provide an appropriate circulatory cooling for the machine aggregates of the tunnelling or extraction machine in order to ensure cooling irrespective of an external water supply.

SUMMARY OF THE INVENTION

The invention aims at providing a dry dust removal device of the initially defined kind to be used, in particular, in potassium mines, which impedes the tunnelling or extraction machine as slightly as possible and by which the driving performance is not affected by the constantly required renewal of, or additions to, the exhaust duct. Furthermore, the invention aims at providing a device of as low a structure as possible and as machine-integrated as possible, which at the same time offers the opportunity of extracting the separated dust by conveying means. Finally, the invention aims at providing an enhanced cooling of machine aggregates at high temperatures at place, in addition to such dry dedusting. To solve this object the dry dust removal device according to the invention substantially consists in that a filter element is arranged in a housing above the conveyor of the tunnelling or extraction machine, that the housing has closeable openings provided between the filter element and the conveyor device arranged therebelow, and that the air outlet opening of the dry dust removal device is connected to the side of the filter element facing away from said closeable openings. By the fact that a filter element is arranged in a housing above the conveyor device of the tunnelling or extraction machine, it has become feasible to clean this filter element at regular intervals, for instance, by blowing or pressing out dust from the filter elements by compressed air or mechanical means and to discharge the portion of separated solids retained in the filter via the conveyor device of the tunnelling or extraction machine arranged thereblow. By the fact that the housing comprises closeable openings between the filter elements and the conveyor device arranged therebelow, tight sealing can be safeguarded for the suction or dedusting operation such that the total amount of sucked in air is actually conducted over the filter, to which end the air outlet opening of the dry dust removal device is connected to the side of the filter element facing away from the closeable openings. On the whole, this implies a relatively compact, simple construction of the dry dust removal device, which in no way affects the flexibility and manoeuvrability of the tunnelling or mining machine at a high degree of operational safety. The configuration of the dry dust removal device with a self-contained housing allows a number of additional aggregates, in particular, cooling means, to be arranged within this housing such that the recirculating flow at the same time may be employed for cooling machine aggregates. In a particularly advantageous manner, the configuration according to the invention is devised such that at least one suction fan is arranged between the suction opening and the dry filter and that the drive of the suction fan is coupled to the drive of closing members of the closeable openings. Such a suction fan provided between the suction opening and the dry filter ensures a sufficient suction pressure at the suction openings with the sucked in material being conveyed in the direction towards the dry filter. By the fact that the closeable openings are closed during the suction operation, all of the sucked in material is pressed through the filter, and by the fact that the drive of the suction fan is coupled to the drive of the closing members of the closeable openings, it is ensured that the suction drive is switched off as the closeable openings are opened for the purpose of removing solids contained in the filter. Thus, superfluous whirling and further dust development is safely counteracted during cleansing of the filter.

In principle, it is of course also possible to arrange the suction fan so as to follow the dry filter in the flow direction, such an arrangement having the advantage that the suction fan no longer collides with the remarkable amounts of sucked in solids, thus being subjected to less wear. On the other hand, such an arrangement has the disadvantage that less space is provided in that part of the housing after the filter for arranging coolers and/or heat exchangers. Advantageously, the configuration is devised such that cooling means for machine aggregates or drive motors are arranged in the channel between air filter and outlet openings such that even at high temperatures prevailing at place particularly simple cooling is safeguarded.

To clean the filter the air flow rate at first must be lowered in principle, to which end the suction fan is to be switched off. Cleansing proper may be effected by blowing the filter elements with compressed air. Yet, in a particularly advantageous and simple manner the configuration is devised such that the dry filter is designed to be deformable or is arranged within an elastic frame and actuatable by means of a vibrating or beating drive. By the fact that the dry filter is arranged immediately above the conveyor device, if desired upon interposition of a chute or a funnel-shaped feeding chute, the material shaked out or extracted in this manner and contained in the filter immediately gets on the conveyor device and can be discharged along with the mining material in a simple manner.

A small-construction design that is particularly beneficial in terms of geometry may be achieved in that the outlet openings of the dry dust removal device are connected lateral of and/or above the dry filter. Such a design, moreover, allows for the particularly simple integration of aggregates additionally serving ventilation, which design advantageously may be devised, for instance, in a manner that an exhaust duct is arranged laterally in the space close to the outlet opening of the dust removal device and that a fresh air feed duct opens on the side of the road opposite the exhaust duct behind the tunnelling or mining machine. In this manner, a directed flow with a high portion of fresh air is safeguarded in the region of the work surface, and by the exhaust ducts as well as the fresh air feed ducts, each being arrangeable independent of the respective position of the tunnelling or extraction machine, mining will not be affected at all.

The closeable openings provided below the dry filter advantageously are designed as a blind having pivotable flaps, wherein such a blind is openable and closeable by a motor in a particularly simple manner and provides for sufficient tightness in the closed position, thus ensuring the almost complete passage of the sucked in material through the dry filter.

DESCRIPTION OF THE DRAWINGS

In the following, the invention will be explained in more detail by way of an exemplary embodiment schematically illustrated in the drawing. Therein.

DETAILED DESCRIPTION OF A PREFERRED EMBODIMENT OF THE INVENTION

Figure 1:
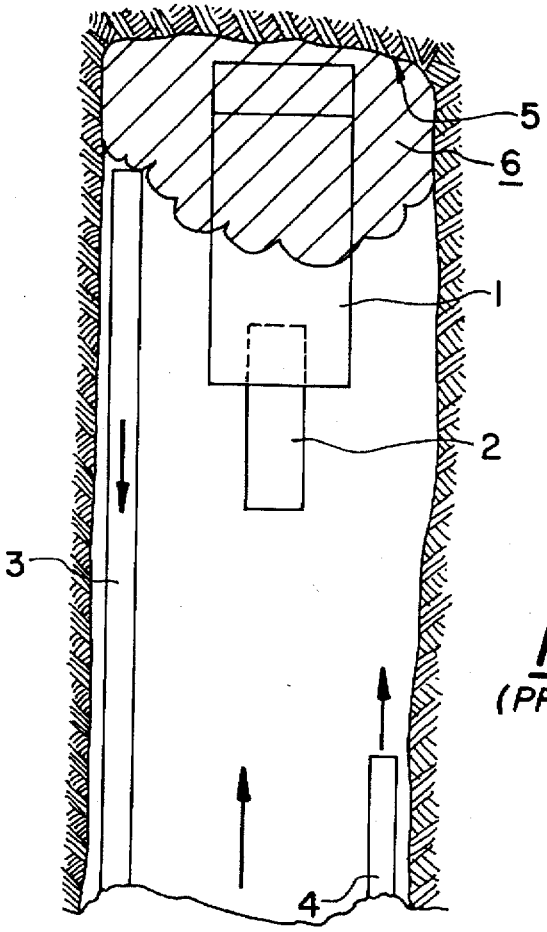
FIG. 1 (PRIOR ART)
FIG. 1 represents conventional dedusting with an exhaust duct mounted in the space and a tunnelling or extraction machine in top view.

From FIG. 1 a extraction machine 1 is illustrated, on the rear end of which a conveyor device 2 is shown. The conveyor device 2 conveys to further conveying means provided in the space, such as, for instance, belt conveyors or mine cars, not illustrated. An exhaust duct 3 and a fresh air duct 4 are arranged in the space. As a rule, the configuration in that case is such that the exhaust duct 3 sucks off a larger amount of air than is fed through the fresh air duct 4. The difference is sucked in over the cross section of the space. Despite a relatively high suction performance, there remains in the zone of the work surface 5 a region 6 in which sight and work are impeded by the dust incurred by the cutting operation.

Figure 2:
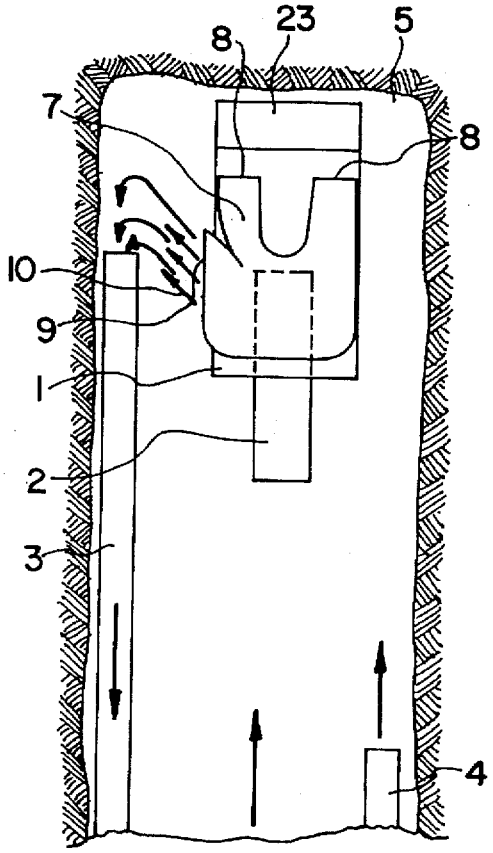
FIG. 2 represents the analogous situation when using dry dust removal device according to the invention.

In the representation according to FIG. 2, a dry dust removal device 7 is arranged on the tunnelling machine 1. Suction is effected through suction openings 8 provided near the cutting roll 23 and hence near the work surface 5, a filter being arranged within the dry dust removal device 7 and the filtered air being ejected through ejection openings 9 in the direction of the arrows 10 towards the suction opening of the exhaust duct 3. On the whole, such a configuration offers the advantage that the dust occurring during the cutting operation can be completely sucked off in the vicinity of the work surface thus considerably improving the conditions at the site. Due to enhanced dedusting, improved vision in the tunnelling system is, of course also, provided at the site.

Figure 3:
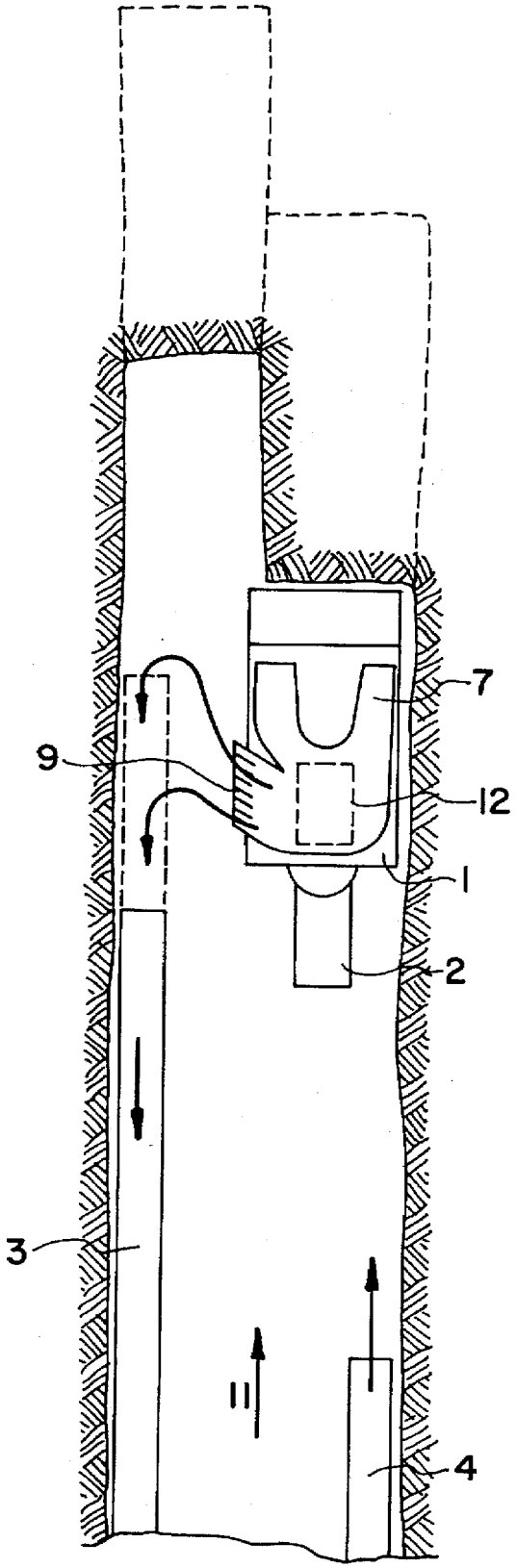
FIG. 3 is the corresponding representation with a wider space.

From the illustration of FIG. 3 it is apparent that the good manoeuvrability of the extraction machine 1 is a prerequisite, in particular, for wide spaces as are common in potassium mines. With such a configuration the existing ventilation may be sufficient though unchanged and the arrangement of a sucking duct 3 as well as a blowing duct 4 for feeding fresh air, again, will do. Also in that case, the respective difference between suction performance and pressure performance of the sucking duct 3 and of the blowing duct 4, respectively, may be realized in the space by feeding fresh air in the sense of arrows 11. The tunnelling machine 1 again carries the integrated dust removal device, and air most largely free of dust again may be ejected in the direction towards the sucking duct 3 upon pre-purification via the integrated filter schematically indicated by 12. In front of the outlet openings 9, a heat exchanger or oil cooler or the like may be arranged within the housing 7 in a simple manner for safely cooling machine aggregates.

Figure 4:
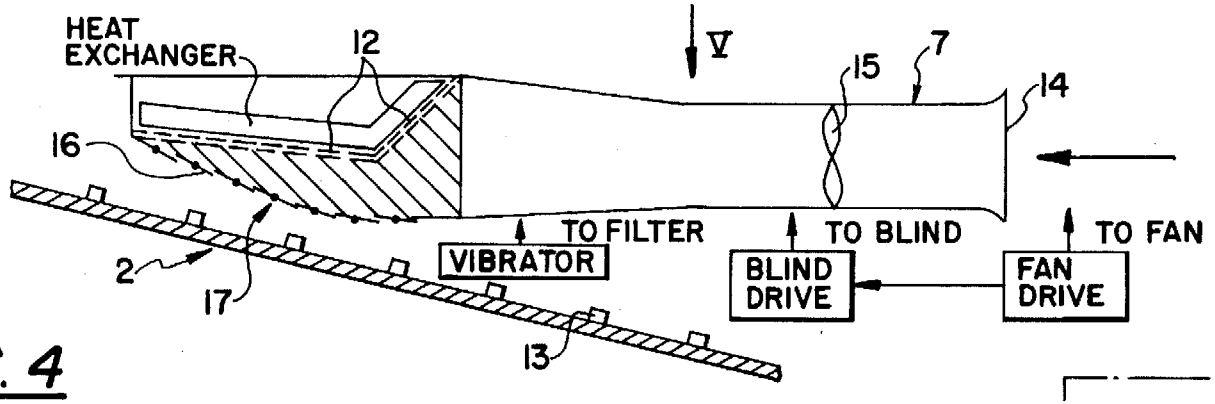
FIG. 4 is a partially sectioned side view of the dry dust removal device.

From the illustration according to FIG. 4, the arrangement of the filter 12 above the conveyor device 2 is schematically illustrated. The conveyor device 2 is designed as a chain conveyor whose pick-up means are denoted by 13. The suction of air near the work surface is effected via suction openings 14 and a fan 15. The dry filter element in the representation according to FIG. 4 is designed as a plate-shaped element and is bent for enlargement of its entry cross section, thus simultaneously ensuring a slight structural height of the dry dust removal device. Furthermore, the filter element can be shaped like a bag in order to obtain an enlargement of the filter surface. The housing of the dry dust removal device on its lower side comprises an opening 17 between the fan 15 and the dry filter element 12, which opening 17 is closeable by a blind 16. After the blind 16 has been opened and the fan 15 has been switched off at the same time, the material retained by the filter can be removed downwardly onto the conveyor device 2 and discharged via the conveyor device. The filter can be cleaned more rapidly by being blown out with compressed air on the one hand, and by means of a vibration drive or by simple beating on the other hand, the material being removed under the action of gravity downwardly through the opening 17 with the blind 16 opened.

Figure 5:
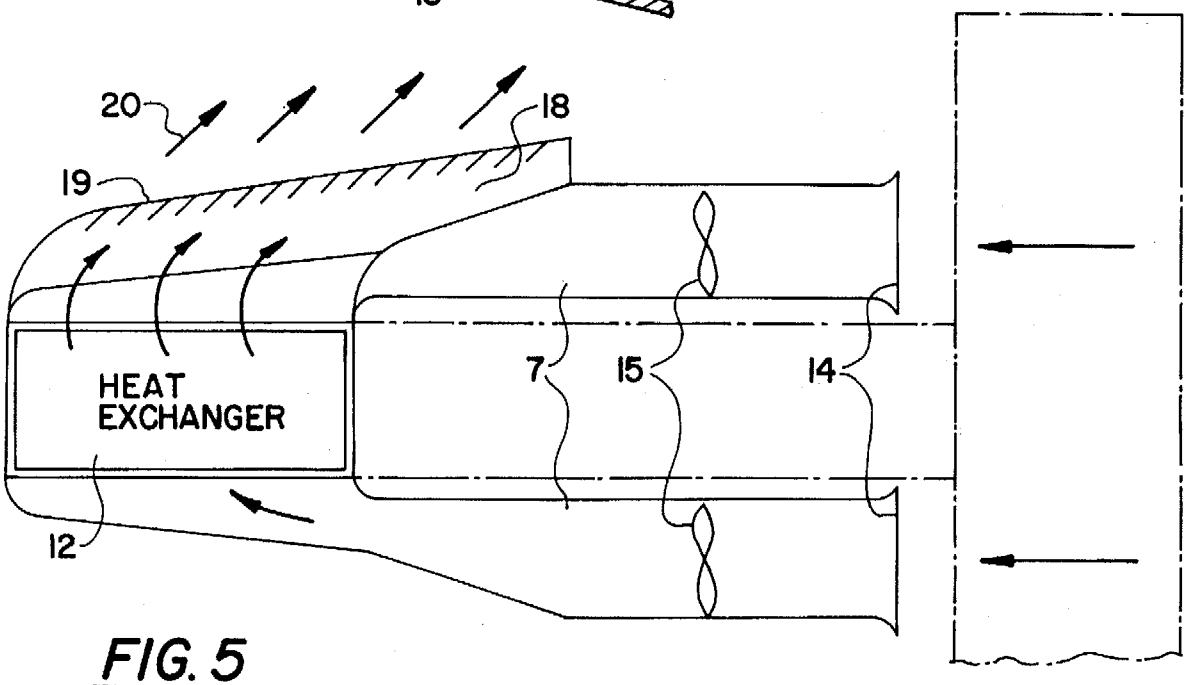
FIG. 5 is a top view on the dry dust removal device according to FIG. 4 along arrow V of FIG. 4.

As can be seen, in particular from the representation according to the FIG. 5, the exit channel 18 for purified air is provided above the dry filter element 12. Lateral outlet openings 19 are arranged there, which allow the purified air to emerge in the sense of arrow 20 and in the direction towards the exhaust duct. In this channel 18 following upon the dry filter, cooling means, namely, in particular, air, oil or air-water heat exchangers are arranged, whereby it is possible to simultaneously cool the respective aggregates by pure air.

Suction is effected through two separate channels seen in top view, each having suction openings 14, wherein an appropriate fan 15 is arranged in either of the two channels in order to guarantee sufficient suction pressure. The sucked in air is fed to the dry filters 12 laterally and from below.

Figure 6:
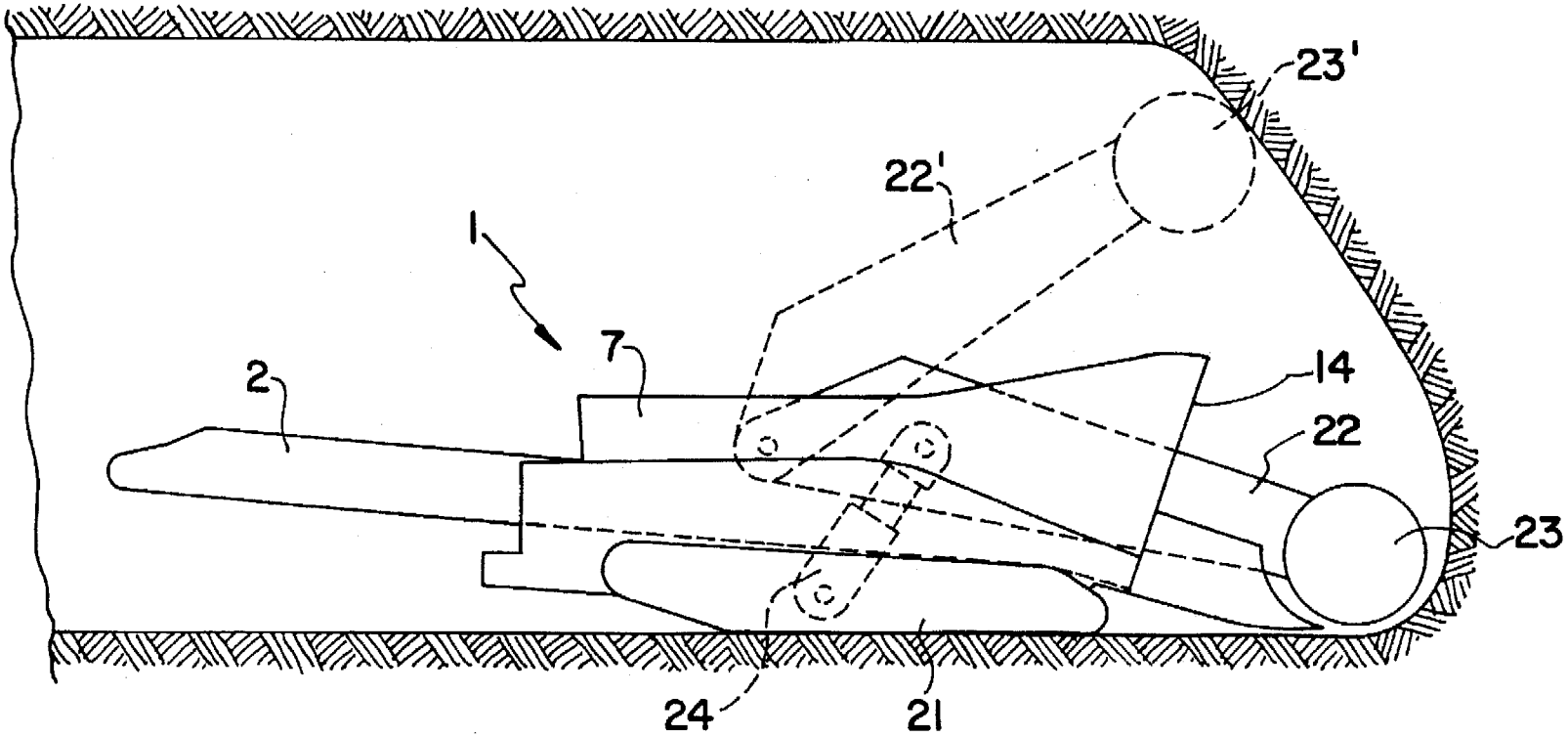
FIG. 6 is a diagrammatic side view of a extraction machine including the dry dust removal device according to the invention.

As can finally be taken from the illustration according to FIG. 6, the lateral suction openings 14 of the integrated dry dust removal device 7 may be designed to be widened in the height direction in the manner of suction slots, thus safely sweeping a large operative region. The extraction machine according to FIG. 6 comprises a tracklaying truck 21, a cantilever arm 22 and cutting rolls 23. The two separate channels including the suction openings either can be connected with the extraction machine 1 stationarily or can be pivoted along with the cutting or cantilever arm 22. The pivotability of the cantilever arm 22 in the height direction is schematically indicated by the broken-line pivoted position 22', in which the cutting rolls assume position 23'. The pivot drive is comprised of a hydraulic cylinder piston aggregate 24.

On the whole, a double suction channel with its suction openings thus is positioned immediately adjacent the cutting drum 23. On account of the two fans 15 provided in the two suction channels, the air sucked off from the space is conducted through the dry filter element 12. The purified air may be diverted back into the space via heat exchangers laterally of the suction duct, to which end adjustable guiding plates may be provided in the region of the outlet openings 19 (FIG. 5).

The dry filter can be cleaned by compressed air, by a vibrating means or optionally even by simple brushes and it is cleaned each time the cutting operation is interrupted.

For the sake of simplicity, the means for bracing the tunnelling or extraction machine have been omitted in the drawing. Cleansing of the filter is feasible in a particularly efficient manner during the process and during each interruption of the cutting procedure. On account of such cyclic cleansing, the dry filter may be kept extremely compact, and the direct connection of the ducts with the suction channels on the tunnelling or extraction machine may be obviated. The cooler integrated in the suction system enhances the operation conditions even at high temperatures at the site.

We claim:

1. A dry dust removal device for a tunneling or extraction machine adapted to cut material from a work surface and to remove such material by a conveyor, said dust removal device comprising:

a housing positioned above the conveyor, a suction opening in the housing located adjacent the work surface, a suction fan for drawing air into the housing through said opening, a filter for receiving air drawn into the housing by the suction fan, a closeable opening in the housing positioned between the filter and the conveyor, said closeable opening comprising a blind having pivotable flaps, and an air discharge opening in the housing on the opposite side of the filter from the closeable opening.

2. A dry dust removal device according to claim 1, wherein said suction fan is positioned between the suction opening and the filter and wherein a drive for the suction fan is coupled to a drive for controlling the closeable opening.

3. A dry dust removal device according to claim 1 or 2, wherein said filter is deformable, the device further comprising means for agitating the filter.

4. A dry dust removal device according to claim 3, further comprising cooling means positioned within the housing between the filter and the air discharge opening.

5. A dry dust removal device according to claim 1 or 2, wherein said discharge opening is positioned in the housing in at least one of lateral and higher positions relative to the filter.

6. A dry dust removal device according to claim 5, wherein said filter is deformable and is retained in a flexible frame, the device further comprising means for agitating the filter.

7. A dry dust removal device according to claim 6, further comprising cooling means positioned within the housing between the filter and the air discharge opening.

8. A dry dust removal device according to claim 5, further comprising cooling means positioned within the housing between the filter and the air discharge opening.

9. A dry dust removal device according to claim 1 or 2, further comprising cooling means positioned within the housing between the filter and the air discharge opening.

10. A dry dust removal device according to claim 1 or 2, wherein the air discharge opening is positioned adjacent an exhaust duct outside of said housing and wherein a fresh air feed duct discharges air on the opposite side of the housing from the exhaust duct.

* * * * *